US006910541B2

(12) United States Patent
Kelpe

(10) Patent No.: US 6,910,541 B2
(45) Date of Patent: Jun. 28, 2005

(54) MACRO ASSISTED CONTROL SYSTEM AND METHOD FOR A HORIZONTAL DIRECTIONAL DRILLING MACHINE

(75) Inventor: Hans Kelpe, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/721,699

(22) Filed: Nov. 25, 2003

(65) Prior Publication Data

US 2004/0104046 A1 Jun. 3, 2004

Related U.S. Application Data

(62) Division of application No. 09/797,327, filed on Mar. 1, 2001, now Pat. No. 6,651,755.

(51) Int. Cl.[7] ..... E21B 7/04

(52) U.S. Cl. ..... 175/26; 175/45; 175/61; 702/9

(58) Field of Search ..... 175/24, 26, 40, 175/45, 61, 62; 73/152.43; 702/9; 33/304; 340/853.4

(56) References Cited

U.S. PATENT DOCUMENTS

| | | | |
|---|---|---|---|
| 4,602,560 A | 7/1986 | Jacky | |
| 4,733,733 A | 3/1988 | Bradley et al. | |
| 4,793,421 A | 12/1988 | Jasinski | |
| 4,854,397 A | 8/1989 | Warren et al. | |
| 4,907,658 A | 3/1990 | Stangl et al. | |
| 5,337,002 A | 8/1994 | Mercer | |
| 5,469,155 A | 11/1995 | Archambeault et al. | |
| 5,553,407 A | 9/1996 | Stump | |
| 5,556,253 A | 9/1996 | Rozendaal et al. | |
| 5,633,589 A | 5/1997 | Mercer | |
| 5,659,985 A | 8/1997 | Stump | |
| 5,698,981 A | 12/1997 | Mercer | |
| 5,704,142 A | 1/1998 | Stump | |
| 5,720,354 A | 2/1998 | Stump et al. | |
| 5,746,278 A | 5/1998 | Bischel et al. | |
| 5,764,062 A | 6/1998 | Mercer | |
| 5,767,678 A | 6/1998 | Mercer | |
| 5,819,859 A | 10/1998 | Stump et al. | |
| 5,904,210 A | 5/1999 | Stump et al. | |
| 6,179,065 B1 | 1/2001 | Payne et al. | |
| 6,233,524 B1 | 5/2001 | Harrell et al. | |
| 6,292,729 B2 | 9/2001 | Falck et al. | |
| 6,389,360 B1 | 5/2002 | Alft et al. | |
| 6,408,952 B1 * | 6/2002 | Brand et al. | 175/24 |

* cited by examiner

*Primary Examiner*—Zakiya Walker
(74) *Attorney, Agent, or Firm*—Crawford Maunu PLLC

(57) ABSTRACT

A system and method for controlling an HDD machine to move a cutting tool along an underground path in accordance with a pre-established bore plan. Cutting tool movement is detected from above-ground. During HDD machine operation, one or more control programs are accessed. Each of the control programs can cause the HDD machine to execute a sequence of pre-defined HDD machine actions. A particular control program of the one or more control programs is executed to augment movement of a drill pipe or the cutting tool.

57 Claims, 14 Drawing Sheets

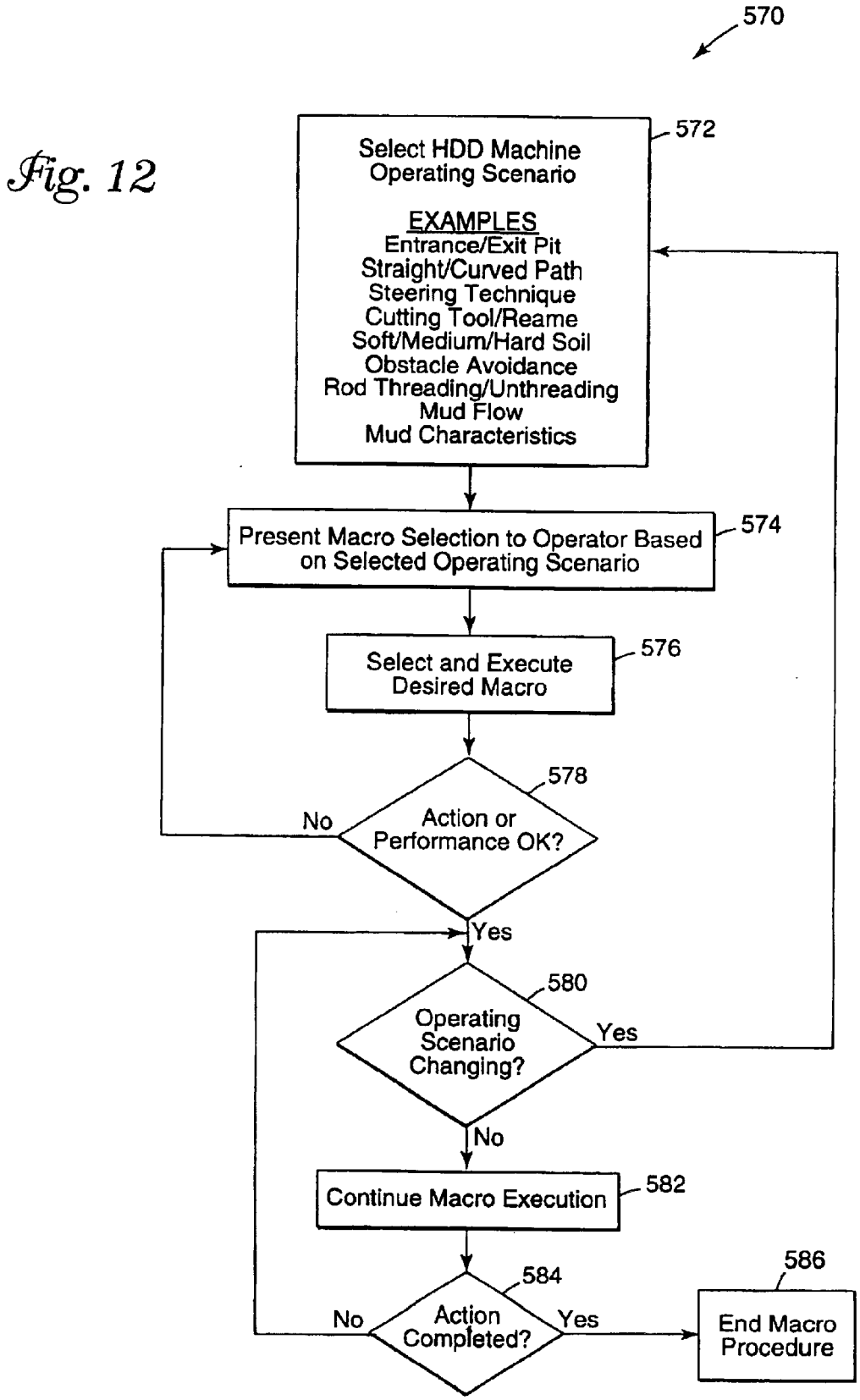
570
Fig. 12
Select HDD Machine Operating Scenario
EXAMPLES
Entrance/Exit Pit
Straight/Curved Path
Steering Technique
Cutting Tool/Reame
Soft/Medium/Hard Soil
Obstacle Avoidance
Rod Threading/Unthreading
Mud Flow
Mud Characteristics
572
Present Macro Selection to Operator Based on Selected Operating Scenario
574
Select and Execute Desired Macro
576
Action or Performance OK?
578
No
Yes
Operating Scenario Changing?
580
Yes
No
Continue Macro Execution
582
Action Completed?
584
No
Yes
End Macro Procedure
586

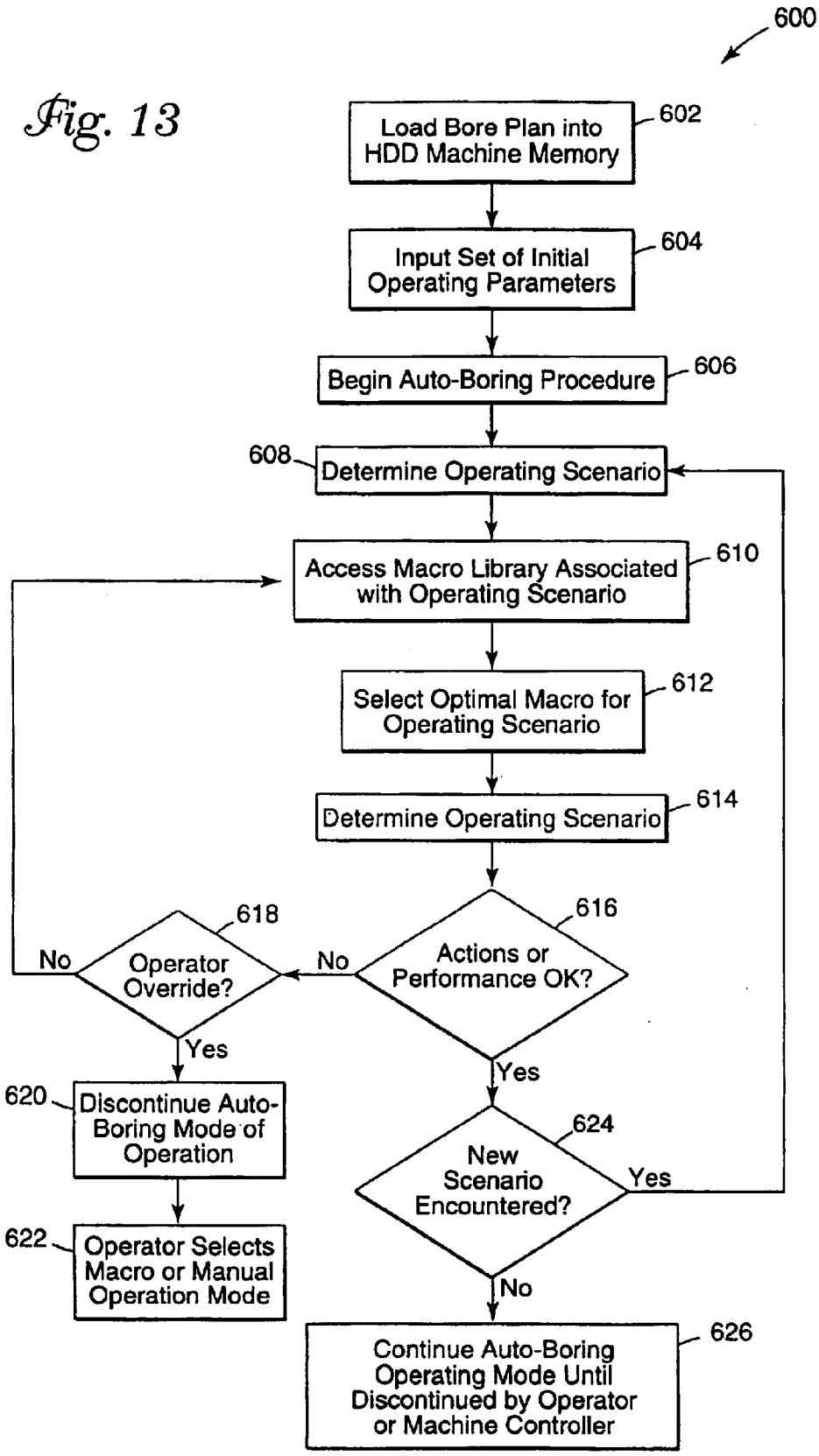
600
Fig. 13
Load Bore Plan into HDD Machine Memory
602
Input Set of Initial Operating Parameters
604
Begin Auto-Boring Procedure
606
608
Determine Operating Scenario
Access Macro Library Associated with Operating Scenario
610
Select Optimal Macro for Operating Scenario
612
Determine Operating Scenario
614
618
616
No
Operator Override?
No
Actions or Performance OK?
Yes
Yes
620
Discontinue Auto-Boring Mode of Operation
624
New Scenario Encountered?
Yes
622
Operator Selects Macro or Manual Operation Mode
No
Continue Auto-Boring Operating Mode Until Discontinued by Operator or Machine Controller
626

MACRO ASSISTED CONTROL SYSTEM AND METHOD FOR A HORIZONTAL DIRECTIONAL DRILLING MACHINE

RELATED APPLICATIONS

This is a divisional of Ser. No. 09/797,327, filed Mar. 1, 2001, now U.S. Pat. No. 6,651,755, which is hereby incorporated by reference herein.

BACKGROUND OF THE INVENTION

The present invention relates generally to the field of underground boring and, more particularly, to a system and method of controlling an underground boring machine through use of macro assistance.

Utility lines for water, electricity, gas, telephone, and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench may pose a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also referred to as horizontal directional drilling (HDD) or trenchless underground boring, a boring system is situated on the ground surface and drills a hole into the ground at an oblique angle with respect to the ground surface. A drilling fluid is typically flowed through the drill string, over the boring tool, and back up the borehole in order to remove cuttings and dirt.

After the boring tool reaches a desired depth, the tool is then directed along a substantially horizontal path to create a horizontal borehole. After the desired length of borehole has been obtained, the tool is then directed upwards to break through to the earth's surface. A reamer is then attached to the drill string which is pulled back through the borehole, thus reaming out the borehole to a larger diameter. It is common to attach a utility line or other conduit to the reaming tool so that it is dragged through the borehole along with the reamer.

It can be appreciated that a highly skilled operator is often needed to operate an underground boring machine at a desired level of productivity and safety. Although advancements have been made in excavation machine automation, the presence of a skilled operator remains desirable in order to achieve increased levels of productivity and safety during excavation. Notwithstanding such automation advancements, the present state of the art still requires the skilled operator to manipulate HDD machine controls on a repetitive basis to perform complex and even routine tasks. Such repetition leads to operator fatigue and may reduce overall excavation productivity.

There exists a need in the excavation industry for an apparatus and methodology for increasing the level of boring machine automation. There exists the further need for such an apparatus and methodology that captures the control capabilities of skilled operators and provides a mechanism for sharing such captured control capabilities by other boring machine operators. The present invention fulfills these and other needs.

SUMMARY OF THE INVENTION

The present invention is directed to a system and method of controlling a horizontal directional drilling (HDD) machine. A method according to an embodiment of the present invention involves controlling an HDD machine to move a cutting tool along an underground path in accordance with a pre-established bore plan. Cutting tool movement is detected from above-ground. During HDD machine operation, one or more control programs are accessed. Each of the control programs can cause the HDD machine to execute a sequence of pre-defined HDD machine actions. The method further involves executing a particular control program of the one or more control programs to augment movement of a drill pipe or the cutting tool.

According to another embodiment, a system for controlling an HDD machine includes an above-ground locator, a user interface comprising a user input device, and a controller communicatively coupled to the user interface. The controller is configured to control the HDD machine to move a cutting tool along an underground path in accordance with a pre-established bore plan. The controller, during HDD machine operation, accesses one or more control programs each causing the HDD machine to execute a sequence of pre-defined HDD machine actions. The controller executes a particular control program of the one or more control programs to augment movement of a drill pipe or the cutting tool.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

BRIEF DESCRIPTION OF THE DRAWINGS

FIGS. 5–13 are flow diagrams depicting various processes associated with macro assisted control of an HDD machine in accordance with several embodiments of the present invention.

Figure 1:
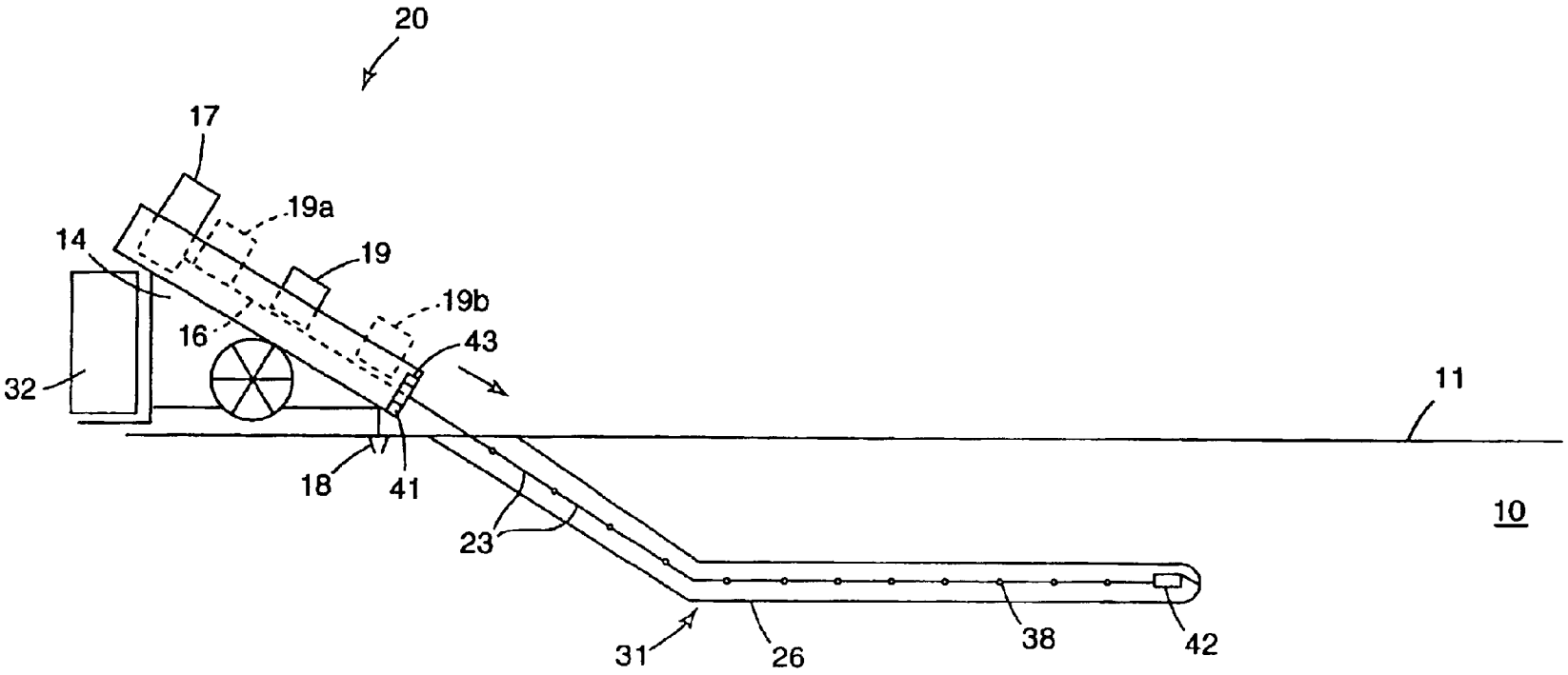
FIG. 1 is a side view of an underground boring apparatus with which a macro assisted control system and method of the present invention may be practiced.

While the invention is amenable to various modifications and alternative forms, specifics thereof have been shown by way of example in the drawings and will be described in detail hereinbelow. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF VARIOUS EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

Referring now to the figures and, more particularly to FIG. 1, there is illustrated an embodiment of a horizontal directional drilling (HDD) machine which incorporates a macro-assisted control system and methodology of the present invention. The term macro, as used in general terms within the context of the present invention, defines a set or series of user definable instructions which may be carried out by an excavation machine or component in an autonomous or semi-autonomous manner to achieve a is desired objective. The term macro is also intended to represent a set or series of computer or combined computer/user definable instructions which may be carried out by an excavation machine or component in an autonomous or semi-autonomous manner to achieve a desired objective.

In the context of certain horizontal direction drilling operations, the term macro is intended to represent a set or series of operator, computer, or combined computer/operator defined instructions which, when executed, causes the HDD machine or an HDD component (e.g., cutting tool locator or guidance system) to operate or alter operation in accordance with the macro. The term macro is also intended to generally represent a set or series of processor or controller defined instructions. The term macro is further intended to represent a set of series of instructions developed by the operator and processor/controller in combination or cooperation.

Operator defined instructions, for example, may be developed through operator manipulation of particular HDD machine/component controls. Electronic, mechanical, hydraulic, and/or manual information associated with operator manipulation of the particular HDD machine/component controls are recorded and stored for re-execution as macro commands or instructions. As mentioned above, the operator defined instructions may be developed partially through operator manipulation and partially by computer or processor assistance (e.g., HDD machine controller refinement of a series of HDD machine/component instructions or operations).

The operator defined instructions may also be developed through computer assistance without operator manipulation of particular HDD machine/component controls, such as by use of computer models, ladder logic, fuzzy logic, artificial intelligence, neural networks or a combination of such techniques. For example, a desired set of HDD machine/component activities may be characterized by a computer model or a set of processor/controller instructions to define a macro. This macro may be executed (or simulated) by the HDD machine or component and subject to refinement or alteration by the HDD machine/component controller/processor. Although this illustrative example represents a highly automated process scenario, the operator may, if desired, intervene in the execution and refinement process as needed or desired.

Turning now to FIG. 1, there is illustrated an HDD machine 20 with which the systems and methods of the present invention may be practiced. FIG. 1 illustrates a cross-section through a portion of ground 10 where a horizontal directional drilling operation takes place. The HDD machine 20 is situated aboveground 11 and includes a platform 14 on which is situated a tilted longitudinal member 16. The platform 14 is secured to the ground by pins 18 or other restraining members in order to prevent the platform 14 from moving during the drilling or boring operation. Located on the longitudinal member 16 is a thrust/pullback pump 17 for driving a drill string 38 in a forward and/or reverse longitudinal direction. The drill string 38 is made up of a number of drill string members or rods 23 attached end-to-end.

Also located on the tilted longitudinal member 16, and mounted to permit movement along the longitudinal member 16, is a rotation motor or pump 19 for rotating the drill string 38 (illustrated in an intermediate position between an upper position 19*a* and a lower position 19*b*). In operation, the rotation motor 19 rotates the drill string 38 which has a cutting head or reamer 42 attached at the end of the drill string 38.

A typical boring operation takes place as follows. The rotation motor 19 is initially positioned in an upper location 19*a* and rotates the drill string 38. While the boring tool 42 is rotated, the rotation motor 19 and drill string 38 are pushed in a forward direction by the thrust/pullback pump 17 toward a lower position into the ground, thus creating a borehole 26.

The rotation motor 19 reaches a lower position 19*b* when the drill string 38 has been pushed into the borehole 26 by the length of one drill string member 23. With the rotation motor 19 situated at lower position 19*b*, a clamp 41 then grips the drill string 38 to stop all downhole drill string movement. The rotation motor 19 is then uncoupled from the clamped drill string 38 and pulled back to upper location 19*a*. A new drill string member or rod 23 is then added to the drill string 38 either manually or automatically. The HDD controller 50 may coordinate the manipulation of drill rods in cooperation with an automatic rod loader apparatus of a known type, such as those disclosed in U.S. Pat. Nos. 5,556,253 and 6,179,065, which are hereby incorporated herein by reference in their respective entireties. The clamping mechanism then releases the drill string and the thrust/pullback pump 17 drives the drill string 38 and newly added rod 23 into the borehole. The rotation motor 19 is thus used to thread a new drill string member 23 to the drill string 38, and the rotation/push process is repeated so as to force the newly lengthened drill string 38 further into the ground, thereby extending the borehole 26.

Commonly, water or other fluid is pumped through the drill string 38 by use of a mud or water pump. If an air hammer is used as the cutting implement 42, an air compressor is employed to force air/foam through the drill string 38. The water/mud or air/foam flows back up through the borehole 26 to remove cuttings, dirt, and other debris. A directional steering capability is provided for controlling the direction of the boring tool 42, such that a desired direction can be imparted to the resulting borehole 26. Exemplary systems and methods for controlling an HDD machine of the type illustrated in the Figures are disclosed in commonly assigned U.S. Pat. Nos. 5,746,278 and 5,720,354, which are hereby incorporated herein by reference in their respective entireties.

Figure 2:
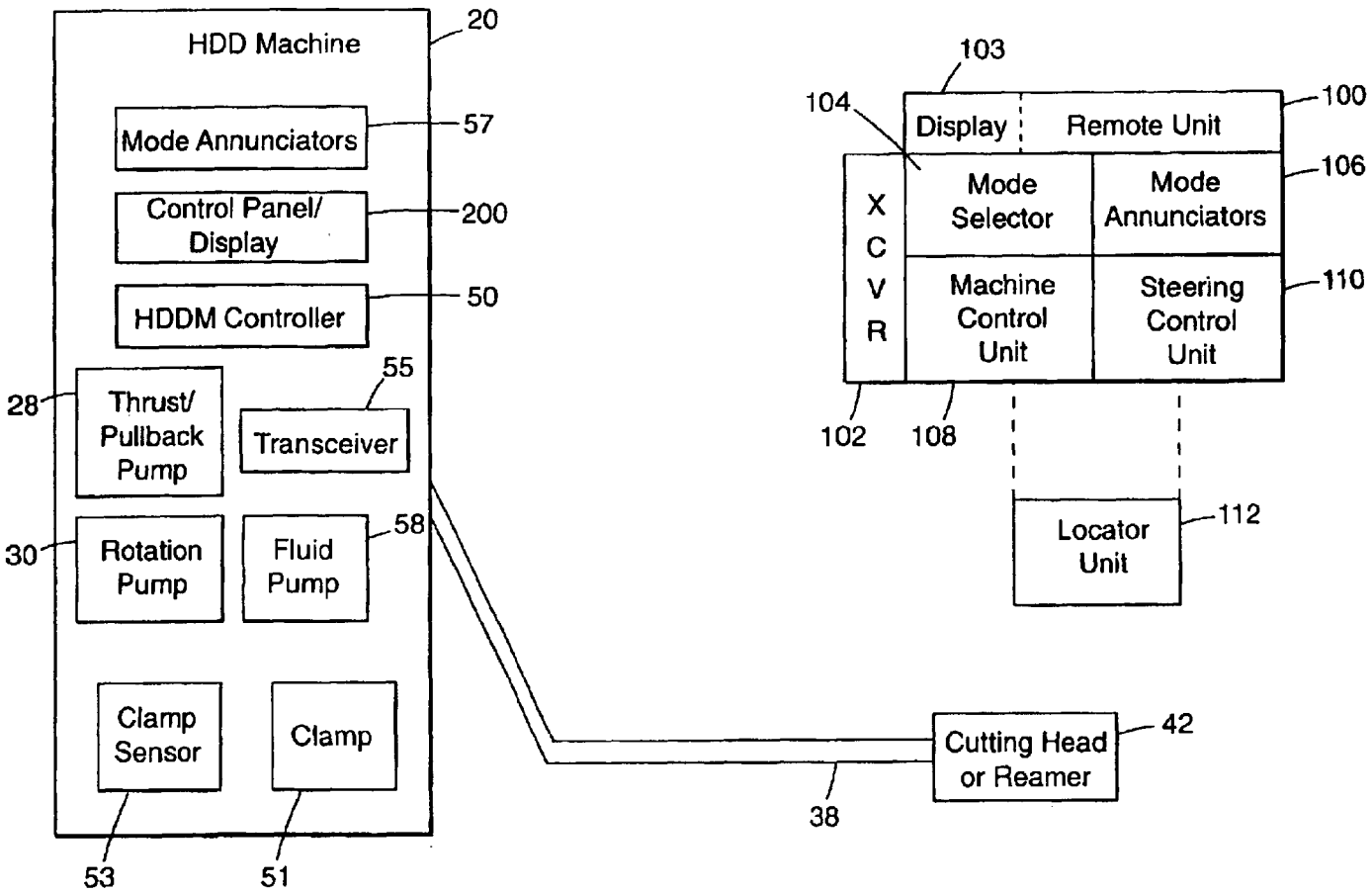
FIG. 2 is a block diagram of a remote unit operable by a remote operator that cooperates with a controller of a horizontal directional drilling (HDD) machine to implement a macro-assisted control methodology in accordance with an embodiment of the present invention.

FIG. 2 is a block diagram of a remote unit 100 that cooperates with a controller 50 of a horizontal directional drilling machine (HDDM) to implement a remote macro-assisted control methodology in accordance with an embodiment of the present invention. Many of the components of HDD machine 20 shown in FIG. 2 are generally representative of those having like numerical references with respect to HDD machine 20 shown in FIG. 1. The HDD machine shown in FIG. 1 may be readily retrofitted to include the system components and/or controller software associated with the system of FIG. 2 in order to implement a macro-assisted control methodology according to the principles of the present invention.

With continued reference to FIG. 2, HDD machine 20 includes a main controller or processor, referred to herein as HDDM controller 50, which controls the operations of HDD machine 20 when operating in several different modes, including a macro-assisted control mode. HDDM controller 50 controls the movement of a cutting head or reamer 42 and drill string 38 by appropriately controlling a thrust/pullback pump 28, alternatively referred to as a displacement pump 28, and a rotation pump 30, each of which is mechanically coupled to the drill string 38. HDDM controller 50 also controls a fluid pump 58, alternatively referred to as a "mud" pump, which dispenses a cutting fluid (e.g., water, mud, foam, air) to the cutting head 42 via the drill string 38.

The HDD machine 20 further includes a clamping apparatus 51 which is used to immobilize the drill string 38 during certain operations, such as when adding or removing a drill rod to/from the drill string 38. In one operating mode, the HDD controller 50 provides for limited usage of the thrust/pullback pump 28 and rotation pump 30 when operating in a macro-assisted control mode, primarily for enhanced safety reasons. For example, the HDD controller 50 may permit limited thrust/pullback pump 28 and rotation pump 30 usage when initially testing out a given macro. The temporary limits placed on HDD machine operations may be eliminated on a progressive or immediate basis as macro testing continues and proves to meet the desired objectives.

HDDM controller 50 is further coupled to a display 34 and/or a number of mode annunciators 57. Display 34 may be used to communicate various types of information to the HDD machine operator, such as pump pressures, engine output, boring tool location and orientation data, operating mode information, remote steering and operating requests/commands, and the like. Mode annunciators 57 provide the machine operator with particularized information concerning various functions initiated by or in cooperation with remote unit 100. Mode annunciators 57 typically include one or more visual, audible, and/or tactile (e.g., vibration) indicators. A transceiver 55 is provided on HDD machine 20 to facilitate the communication of signals and information between HDD machine 20 and remote unit 100.

Remote unit 100 is preferably configured as a hand-held unit that incorporates manually actuatable controls and control hardware and software (e.g., via machine control unit 108) which cooperate to control all or a subset of HDD machine activities. In one embodiment, all of the controls and/or switches provided on the hand-held remote unit 100 are readily actuatable by an operator using only one hand, that being the hand holding the remote unit 100. The remote unit 100 may incorporate ergonomic features that facilitate easy grasping and retention of the unit 100 in the hand, and features that promote easy interaction between the remote user and the remote unit 100.

In accordance with another embodiment, remote unit 100 may be incorporated into a portable locator or tracking unit 112 as is known in the art. A remote operator may use locator 112, which incorporates remote unit 100 functionality, to perform conventional tasks, such as scanning an area above the cutting head 42 for purposes of detecting a magnetic field produced by an active sonde provided within the cutting head 42. In addition to the availability of standard locator functions, various macro learning, testing, and execution functions according to the present invention may be implemented using a locator modified to incorporate remote unit 100 functionality. Examples of such known locators are disclosed in U.S. Pat. Nos. 5,767,678; 5,764,062; 5,698,981; 5,633,589; 5,469,155; 5,337,002; and 4,907,658; all of which are hereby incorporated herein by reference in their respective entireties. These systems may be advantageously modified to include components and functionality described herein to provide for macro-assisted remote control capabilities in accordance with the principles of the present invention.

Remote unit 100 includes a mode selector 104 and a number of mode annunciators 106. Mode selector 104 permits the remote operator to select one of a number of different standard or macro-assisted operating modes (e.g., Macro-Steering, Macro-Drilling, Macro-Creep, Macro-Rotate, Macro-Push, Macro-Pullback modes), and when implementing boring tool steering changes (manual or macro-assisted) via steering control unit 110. An indication of the selected mode and other information, such as a warning indication, is communicated to the remote user via mode annunciators 106. Mode annunciators 106 typically include one or more visual, audible, and/or tactile (e.g., vibration) indicators. Alternatively, or in addition to mode annunciators 106, remote unit 100 may be provided with a display 103.

A transceiver 102 of remote unit 100 permits the remote unit 100 to communicate with HDD machine 20 via transceiver 55 of HDD machine 20. To facilitate communication between remote unit 100 and HDD machine 20, one or more repeaters may be situated at appropriate locations at the drilling site. The use of repeaters may be desirable or required when hills or other natural or manmade obstructions lie between the remote unit 100 and HDD machine 20. Repeaters may also be used to provide for increased signal-to-noise (SNR) ratios. Communication between remote unit 100 and HDD machine 20 may be enhanced by using one or more repeaters when drilling boreholes having lengths on the order of thousands of feet (e.g., one mile). Those skilled in the art will appreciate that a number of communication links and protocols may be employed to facilitate the transfer of information between remote unit 100 and HDD machine 20, such as those that employ wire or free-space links using infrared, microwave, laser or acoustic telemetry approaches, for example.

Figure 3A:
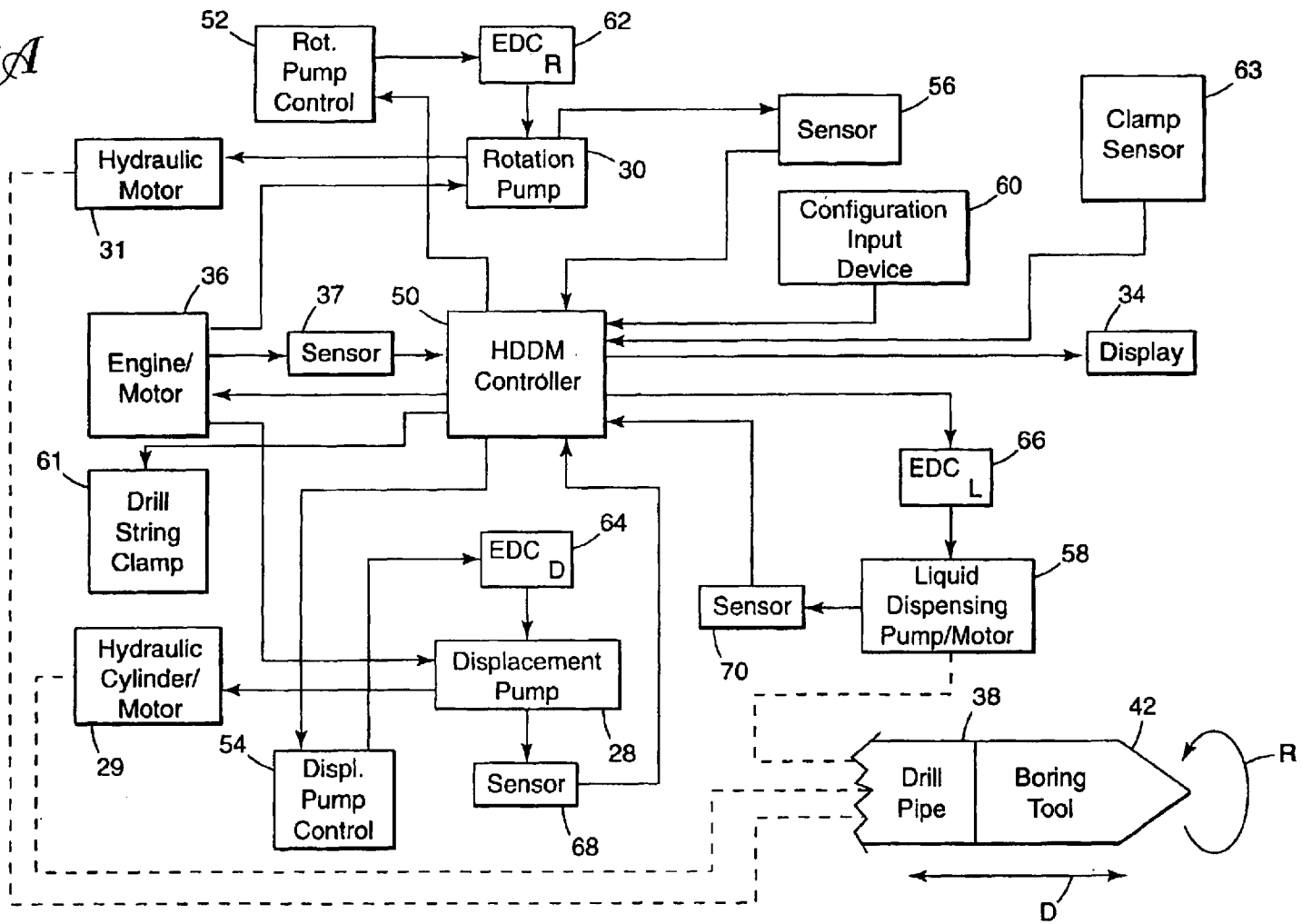
FIG. 3A depicts a control system of an HDD machine that implements a macro assisted mode of operation in accordance with an embodiment of the present invention.
Figure 3B:
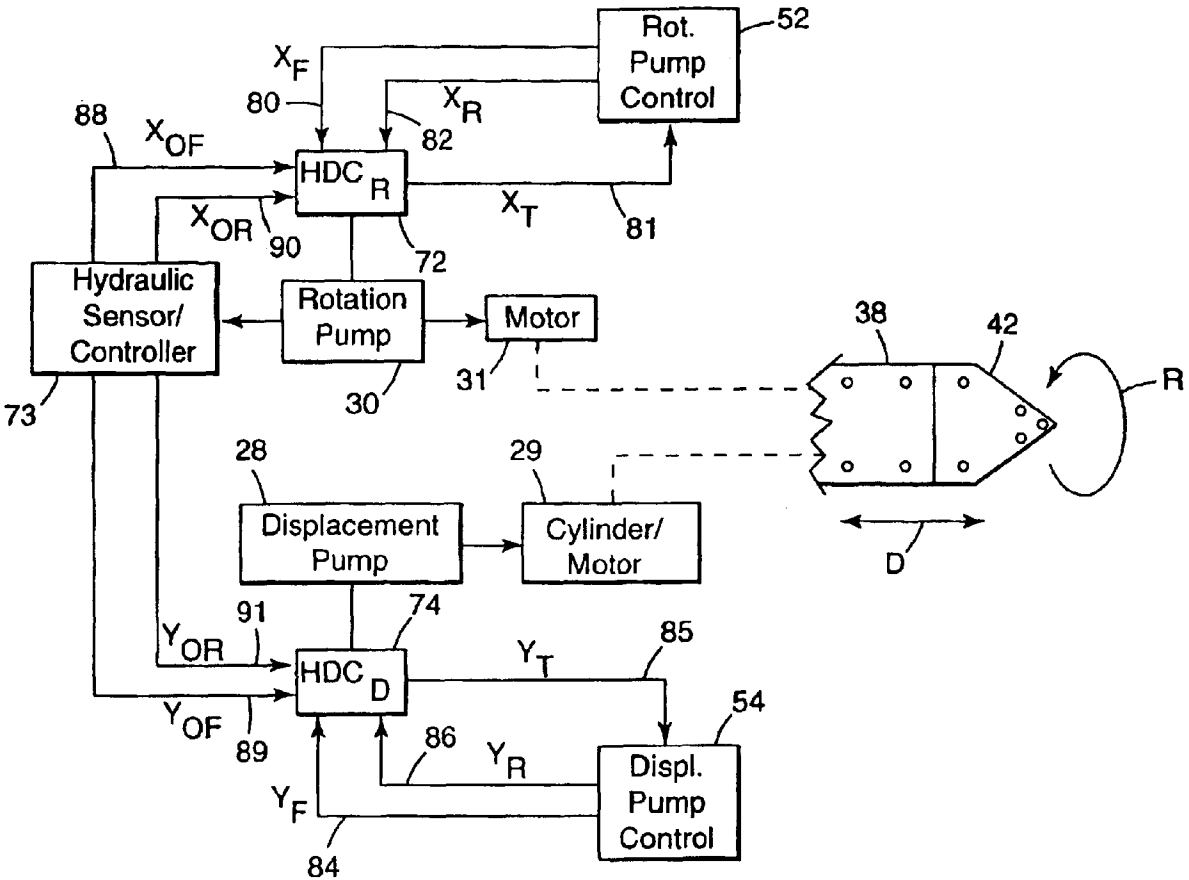
FIG. 3B depicts a control system of an HDD machine that implements a macro assisted mode of operation in accordance with an another embodiment of the present invention.

Referring now to FIG. 3A, there is illustrated one embodiment of a control system of an HDD machine for controlling drilling activities during normal operation and for implementing a macro-assisted control methodology in accordance with the principles of the present invention. Although specific control system implementations are depicted in FIG. 3A and FIG. 3B, it will be understood that a control system suitable for effecting a macro-assisted control methodology of the present invention may be implemented using electrical, mechanical, or hydraulic control elements or any combination thereof.

With continued reference to FIG. 3A, the operation of a displacement pump 28 and a rotation pump 30 is controlled by HDDM controller 50. HDDM controller 50 is also coupled to an engine/motor 36 of the HDD machine which provides source power respectively to the displacement and rotation pumps 28 and 30. A rotation pump sensor 56 is coupled to the rotation pump 30 and HDDM controller 50, and provides an output signal to HDDM controller 50 corresponding to a pressure or pressure differential, or alternatively, a speed of the rotation pump 30. A rotation pump control 52 and a displacement pump control 54 provide for manual control over the rate at which drilling or back reaming is performed. During idle periods, the rotation and displacement pump controls 52 and 54 are preferably configured to automatically return to a neutral setting at which no rotation or displacement power is delivered to the cutting head 42 for purposes of enhancing safety. Rotation and displacement pump controls 52 and 54 produce movement/signals that, according to embodiments of the present invention, are recorded during recording of a macro. During execution of a given macro, the recorded movement/signals are used to effectively mimic manually produced rotation and displacement pump control movement/signals.

During normal or macro-assisted operation, modification to the operation of the displacement pump 28 and rotation pump 30 is controlled by HDDM controller 50. A rotation pump sensor 56, coupled to the rotation pump 30 and HDDM controller 50, provides an output signal to HDDM controller 50 corresponding to the pressure or pressure differential, or alternatively, the rotation speed of the rotation pump 30. A displacement pump sensor 68, coupled to the displacement pump 28 and HDDM controller 50, provides an output signal to HDDM controller 50 corresponding to the pressure level of the displacement pump 28 or, alternatively, the speed of the displacement pump 28.

An operator, either manually or via macro-assisted operation, typically sets the rotation pump control 52 to a desired rotation setting during a drilling or back reaming operation, and modifies the setting of the displacement pump control 54 in order to change the rate at which the cutting head 42 is displaced along an underground path when drilling or back reaming. The rotation pump control 52 transmits a control signal to an electrical displacement control 62 ($EDC_R$) coupled to the rotation pump 30. $EDC_R$ 62 converts the electrical control signal to a hydrostatic control signal which is transmitted to the rotation pump 30 for purposes of controlling the rotation rate of the cutting head 42.

The operator also sets, either manually or via macro-assisted operation, the displacement pump control 54 to a setting corresponding to a preferred boring tool displacement rate. The operator may modify the setting of the displacement pump control 54 to effect gross changes in the rate at which the cutting head 42 is displaced along an underground path when drilling or back reaming. The displacement pump control 54 transmits a control signal to a second EDC 64 ($EDC_D$) coupled to the displacement pump 28. $EDC_D$ 64 converts the electrical control signal received from the controller 64 to a hydrostatic control signal, which is then transmitted to the displacement pump 28 for purposes of controlling the displacement rate of the cutting head 42.

The HDD machine also includes a fluid (air, liquid, foam, or a combination of same) dispensing pump/motor 58 (hereinafter referred to as a liquid dispensing pump) which communicates liquid through the drill string 38 and cutting head 42 for purposes of providing lubrication, power (e.g., air hammer), and enhancing boring tool productivity. The operator, either manually or via macro-assisted operation, generally controls the liquid dispensing pump 58 to dispense liquid, preferably water, a water/mud mixture or a foam, at a preferred dispensing rate by use of an appropriate control lever or knob provided on the control panel 32 shown in FIG. 1. Alternatively, the dispensing rate of the liquid dispensing pump 58, as well as the settings of the rotation pump 30, displacement pump 28, and engine 36, may be set and controlled using a configuration input device 60, which may be a keyboard, keypad, touch sensitive screen or other such input interface device, coupled to HDDM controller 50. HDDM controller 50 receives the liquid dispensing setting produced by the control lever/knob provided on the control panel 32 or, alternatively, the configuration input device 60, and transmits an electrical control signal to a third EDC 66 ($EDC_L$) which, in turn, transmits a hydrostatic control signal to the liquid dispensing pump 58.

A feedback control loop, during manual or macro-assisted operation, provides for automatic adjustment to the rate of the displacement pump 28 and rotation pump 30 in response to varying drilling conditions. The feedback control loop further provides for automatic adjustment to the rate at which a drilling fluid is dispensed to the cutting head 42. HDDM controller 50 communicates the necessary control signals to the displacement pump 28, rotation pump 30, and liquid dispensing pump 58 to implement the local and remote steering/remote control methodologies of the present invention.

In FIG. 3B, there is illustrated an alternative embodiment of the present invention, in which control of the displacement pump 28 is provided through hydraulic control signals, rather than electrical control signals employed in the embodiment described hereinabove. In accordance with one mode of operation, the operator, either manually or via macro-assisted operation, sets the rotation pump control 52 to an estimated optimum rotation setting for a drilling or reaming operation. The rotation pump control 52 transmits a control signal to a hydraulic displacement control ($HDC_R$) 72 which, in turn, transmits a hydraulic control signal to the rotation pump 30 for purposes of controlling the rotation rate of the cutting head or reamer 42.

Various types of hydraulic displacement controllers (HDC's) use hydraulic pilot signals for effecting forward and reverse control of the pump servo. A pilot signal is normally controlled through a pilot control valve by modulating a charge pressure signal typically between 0 and 800 pounds-per-square inch (psi). $HDC_R$ 72, in response to the operator changing the setting of the rotation pump control 52, produces corresponding changes to the forward pilot signal, $X_F$ 80, and the reverse pilot signal, $X_R$ 82, thus altering the rate of the rotation pump 30. Line $X_T$ 81 is a return line from $HDC_R$ 72 to the rotation pump control 52. Similarly, in response to the operator changing the setting of the displacement pump control 54, either manually or via macro-assisted operation, the displacement pump control 54 correspondingly alters the forward pilot signal, $Y_F$ 84, and the reverse pilot signal, $Y_R$ 86, of $HDC_D$ 74, which controls the displacement pump 28, thus altering the displacement rate. Line $Y_T$ 85 is a return line from $HDC_D$ 74 to the displacement pump control 54.

The hydraulic sensor/controller 73 senses the pressure of the rotation pump 30 or, alternatively, the rotation speed of the rotation pump 30, by monitoring the flow rate through an orifice to measure rotation, and is operable to transmit hydraulic override signals $X_{OF}$ 88 and $X_{OR}$ 90 to the $HDC_R$ 72, and hydraulic override signals $Y_{OF}$ 89 and $Y_{OR}$ 91 to the $HDC_D$ 74. When, for example, the hydraulic sensor/ controller 73 senses that the pressure of the rotation pump 30 has exceeded the upper acceptable pressure limit, $P_L$, override signals $Y_{OF}$ 89 and $Y_{OR}$ 91 are transmitted to the $HDC_D$ 74 in order to appropriately reduce the cutting head or reamer displacement rate while maintaining the rotation of the cutting head or reamer at a desired rate, such as a substantially constant rate. Once the pressure of the rotation pump 30 has recovered to an acceptable level, the hydraulic sensor/controller 73 instructs $HDC_D$ 74 to increase the displacement rate. The hydraulic sensor/controller 73 may be coupled to an HDDM controller of the type described in connection with FIG. 3A or, alternatively, may incorporate the functionality of HDDM controller 50.

Figure 4:
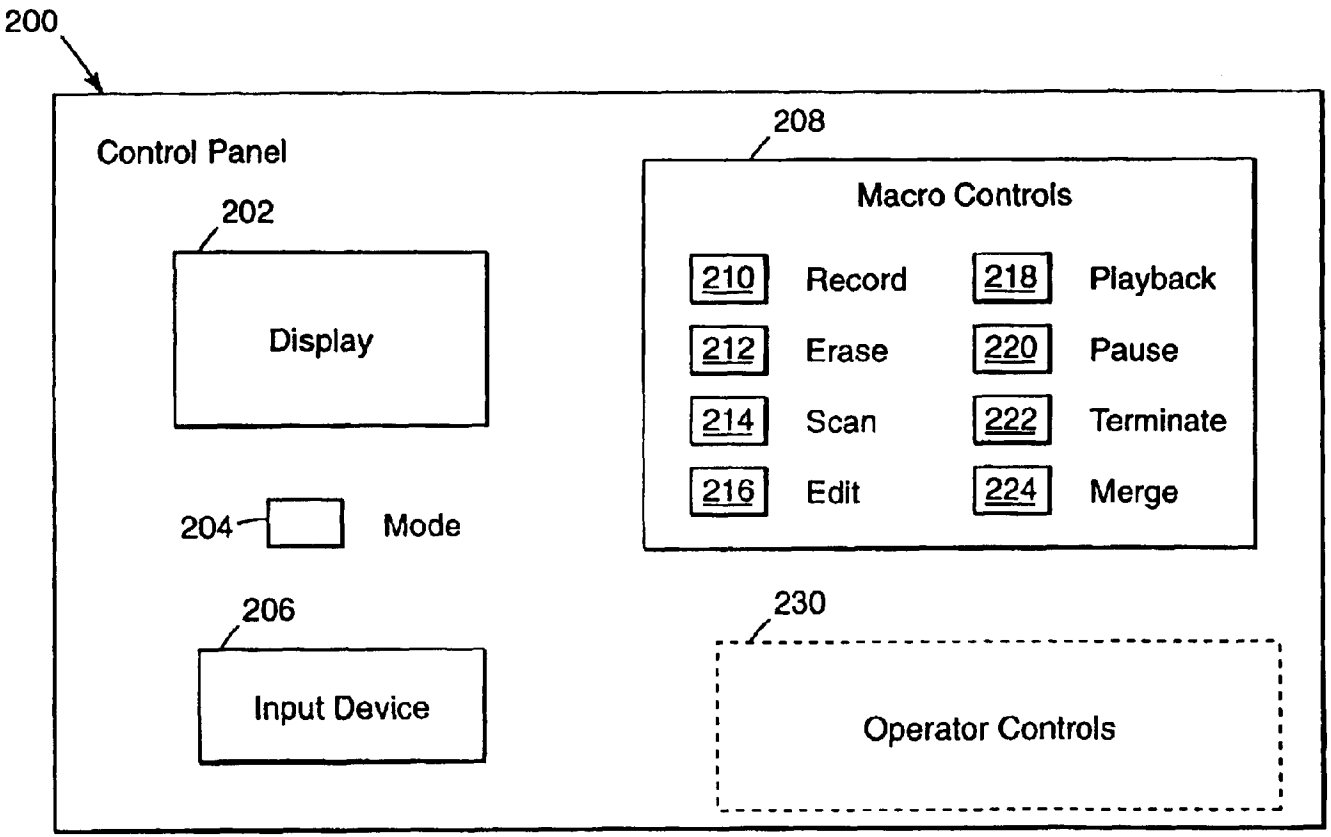
FIG. 4 illustrates a control panel of an HDD machine or remote control unit which includes several macro controls and various input/output devices for facilitating macro assisted control of an HDD machine in accordance with an embodiment of the present invention.

Turning now to FIG. 4, there is illustrated an embodiment of a control panel 200 which may be provided at the HDD machine 20, such as that depicted in FIGS. 1 and 2. Alternatively, control panel 200 may be provided on a control apparatus separate from the HDD machine 20. For example, control panel 200 may be integrated into a portable remote control unit or a portable locator, such as remote unit 100 shown in FIG. 2.

Control panel 200 includes a number of control and display regions which provide for a high level of operator interaction with the HDD machine 20 and the electronic data acquired and used by the macro processing units of the present invention. A number of operator controls 230 are provided for actuation by an operator during manual, automatic, semi-automatic, or macro control of the HDD machine 20. Typical operator controls 230 include a variety of levers, switches, and knobs that control the operation of the HDD machine 20, such as rotation and displacement pump controls 52 and 54 discussed previously. Other types of operator controls 230 may also be provided on the control panel 200, including those required to effect communication with a remote unit 100, such as that shown in FIG. 2, a locator unit 112, and/or electronics provided in a cutting head or reamer 42.

A macro control panel 208 is also provided on main control panel 200. Within the macro control panel region are a number of controls which are actuatable by an operator. By way of example, the user may actuate various ones of the macro controls provided on panel 208 for purposes of performing various macro-related functions. For example, a record control 210 allows the operator to record a particular series of central functions for storage in memory. An erase control 212, for example, may be used to erase all or portions of a previously recorded macro. A scan control 214 may be used by the operator to review various steps of a given macro or series of macros.

A given macro, by way of further example, may be selected for scanning or reviewing by the operator. According to one approach, the selected macro may be presented on display 202 of control panel 200. Various steps that define the selected macro may be presented on display 202. The macro may be displayed in any number of formats, including, for example, a ladder logic format. Various layers of a given macro may be presented. For example, the main function or series of functions performed by the macro may be further broken down into sub-macros that are performed underneath each of the main functions. These sub-macros may be subject to viewing by use of the scan control 214. Additional layers of detail may be reviewed by the operator by use of the scan control 214.

For example, a selected sub-macro may be interrogated to determine which control mechanism, such as which motor, pump, and actuator, sensor, is implicated in the definition of the selected sub-macro. The operator may progress still further into the details of a particular sub-macro by interrogating the operational parameters of a given functional element implicated in the definition of the sub-macro. For example, the inputs, outputs, limits, and status indicators for a particular valve or sensor defined in a given sub-macro may be interrogated and viewed by the operator.

An edit control 216 is also provided on the macro control panel 208. Upon activating the edit control 216, the operator may select a desired macro or sub-macro. The edit function allows for the editing of the particular macro or sub-macro, such as by allowing the operator to modify or append to a particular macro. As with the scan operation, various levels of macro and sub-macro detail may be subject to editing and modification by the operator using the edit control 216.

For example, it is assumed that a series of operator control commands have been recorded so as to define a given macro. The edit control 216 may be activated by the operator to modify, for example, an operating range associated with a given parameter implicated in the macro definition (e.g., range of steering angle, operating temperature threshold, pressure limit, etc.). The operator may modify a given parameter through use of an input device 206 provided on control panel 200.

The input device 206 provided on control panel 200 may take various forms to accommodate various types of input likely to be received by the operator. By way of example, the input device 206 may take the form of a keyboard, mouse, trackball, touch-screen display icons, and other traditional mechanical user input devices. A microphone for inputting voice commands may also be provided on control panel 200. In this case, noise cancellation and voice recognition software may be used to increase the efficacy of a voice command input approach, given the likely presence of significant extraneous noise.

A playback control 218 provides for the selection and execution of a selected macro. During playback of a selected macro, a pause control 220 may be actuated to temporarily suspend execution of the selected macro currently being played back. The user may also terminate playback of a selected macro by actuating a terminate control 222.

A merge control 224 provided on control panel 208 allows the operator to merge together all or selected portions of macros, sub-macros, and/or functions. By way of example, merge control 224 may be actuated to select a first macro and a second macro so that the functionality of the two macros may be merged. In this manner, the functions associated with the two macros may be executed in succession without requiring the operator to select and specifically execute the second of the two macros. Also, merging two macros allows for the selective editing of the merged macro. For example, the functions defining the first and second macro may be ordered as desired to define a merged macro having an operator defined sequence. A merged macro created from two or more existing macros may be stored under a new macro name and subsequently recalled and played back by the operator upon actuation of the playback control 218.

Merging of macro steps or functions may provide for additional functionality by allowing the operator to select desired functions or sets of functions from two or more macros to define a new macro. Merging macros may also involve combining macro steps associated with a first mode of HDD machine operation with macro steps associated with a second mode of HDD machine operation. In this way, a macro may define operations or functions associated with multiple modes of HDD machine operations.

Control panel 200 may also include a mode control 204 which allows the user to select between a number of different operating modes. For example, a number of predefined operating modes may be defined by a corresponding number of operating mode programs. Each of these operating mode programs may be selected through use of mode control 204. By way of example, a number of boring mode programs may be stored, each of which defines a set of operating parameters associated with a given type of boring condition. A boring mode associated with rock drilling, for example, may specify a set of HDD machine parameters appropriate for drilling through rock. Another boring mode program may define HDD machine parameters appropriate for drilling through clay, while another boring mode program may configure the HDD machine to operate optimally in sandstone, for example. Each of the mode programs may themselves be subject to editing or modification by the operator, such as by use of a mode edit control similar to the macro edit control 216 shown on control panel 200.

Figure 5:
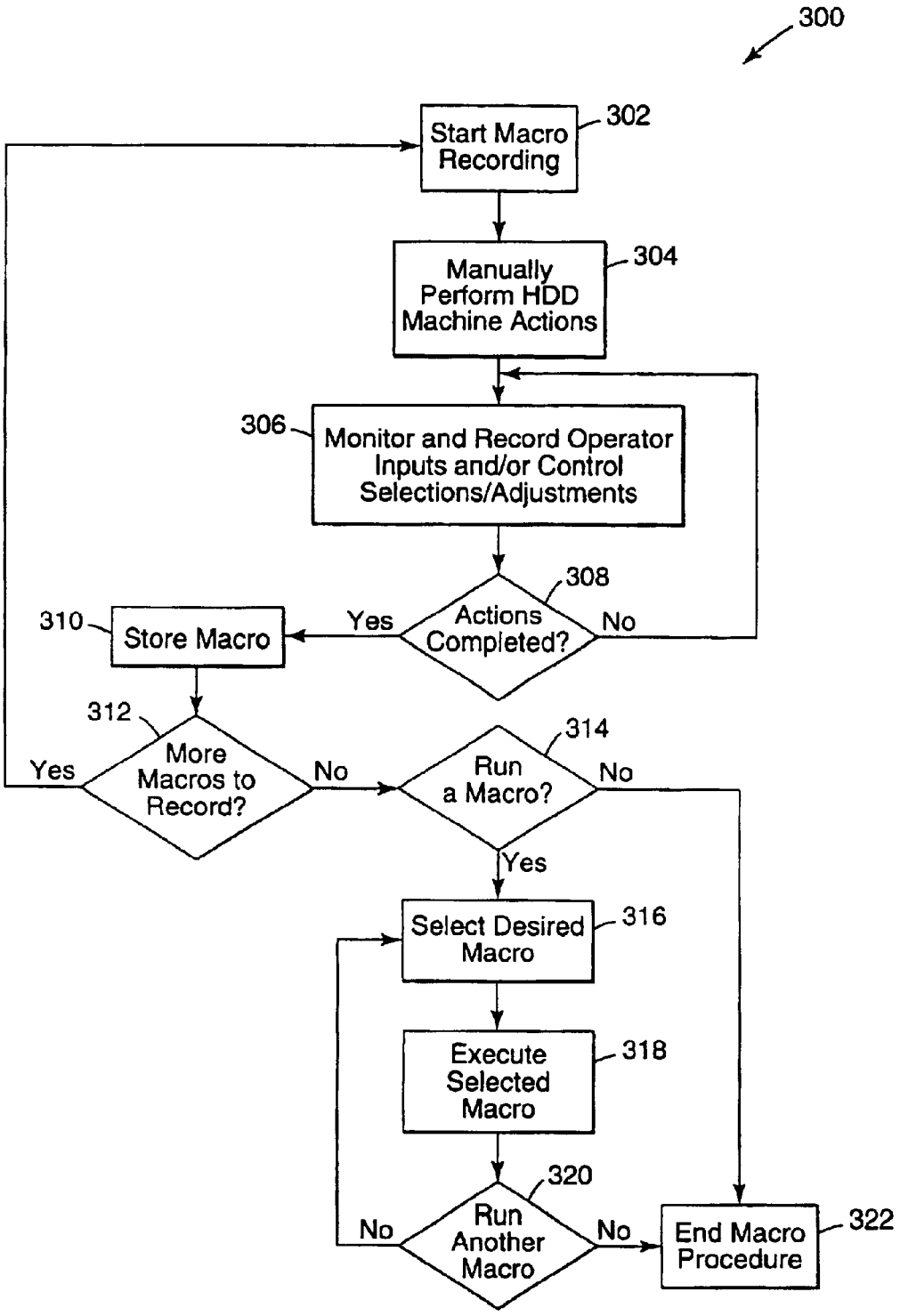

FIG. 5 shows various steps associated with macro creation and execution in accordance with one embodiment of the present invention. The macro generation and execution procedure 300 depicted in FIG. 5 is initiated by starting the recording process 302 of the macro. After initiating macro recording, the operator manually performs 304 the desired HDD machine actions. The electronics of the HDD machine monitors and records the operator inputs and/or the control selections and adjustments 306 made by the operator. The process of monitoring and recording operator inputs and/or control selections/adjustments continues until such time as the desired series of actions is deemed completed 308 by the operator. The macro is then stored 310, preferably in nonvolatile alterable memory (e.g., Flash memory, EEPROM).

If the operator desires to record additional macros 312, the process of starting macro recording 302, manually performing the desired HDD machine actions 304, and monitoring and recording of same 306 is repeated until such time as the additional series of actions are completed 308, which then results in storage of an additional macro 310. Any number of macros may be recorded by the HDD machine operator, limited only by the amount of memory provided on the HDD machine or other memory used to store the macros (e.g., a personal computer coupled to the HDD machine, smart cards, and memory modules).

The operator may wish to run a particular macro 314 or, alternatively, may simply end the macro procedure 322 after completing the recording operation. If the operator wishes to run a particular macro 314, a desired macro is selected 316 and subsequently executed 318. If the operator wishes to run additional macros 320, the selection and execution steps 316, 318 are repeated until such time as the operator terminates the macro procedure 322.

Figure 6:
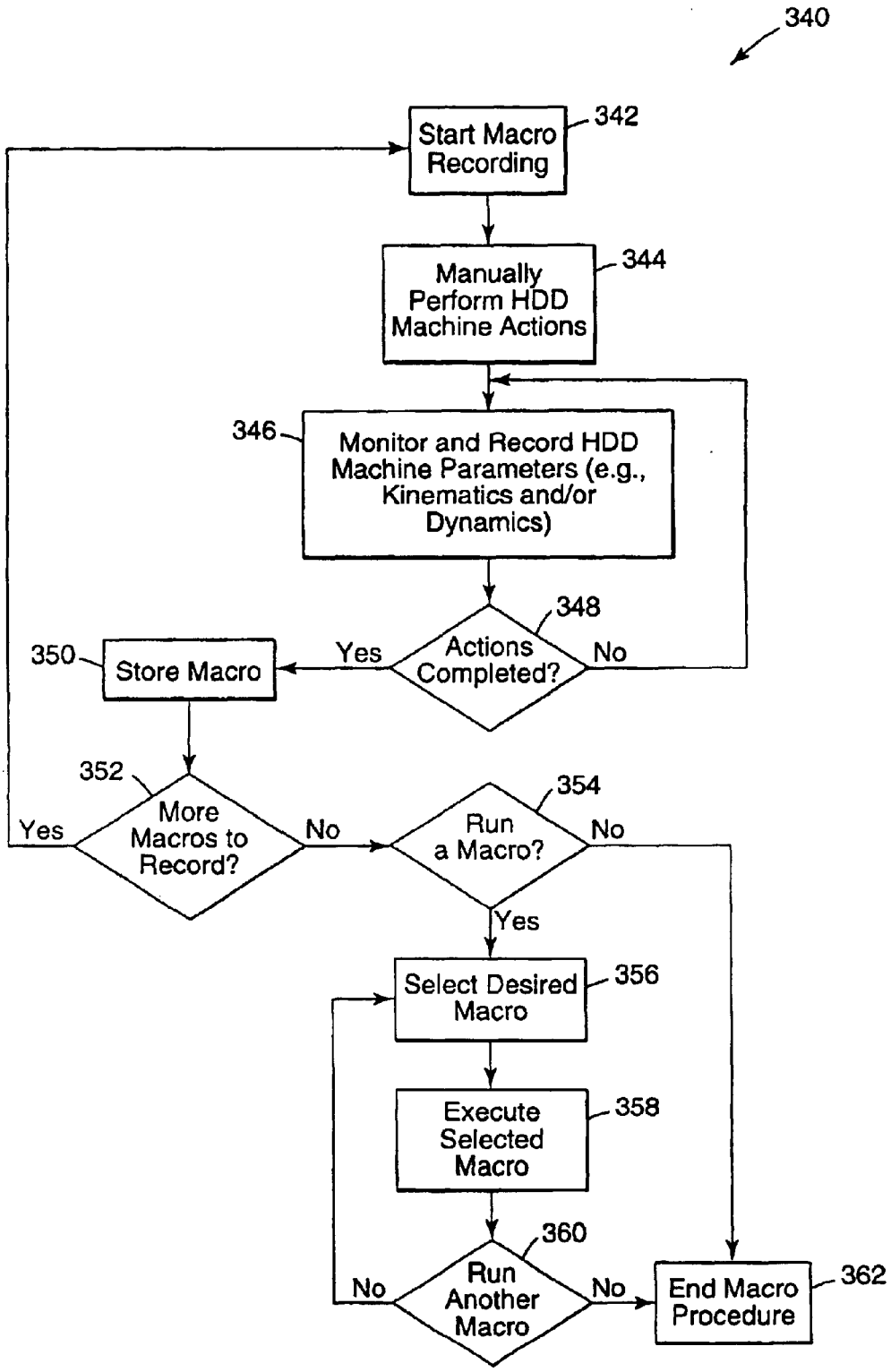

FIG. 6 illustrates various steps associated with recording and executing macros in accordance with another embodiment of the present invention. According to this embodiment, a user starts the macro recording process 342 and then manually performs the desired HDD machine actions 344. In this embodiment, rather than recording operator inputs and control selections as in the embodiment according to FIG. 5, the process of FIG. 6 involves monitoring and recording of HDD machine parameters.

For example, various HDD machine kinematics and/or dynamics may be recorded, typically by receiving sensor signals from various sensors deployed on the HDD machine, drill string, above-ground locator/repeaters, and/or boring head/reamer. When the desired series of actions is completed 348, the macro is stored 350. The user may, if desired, record additional macros 352. One or more stored macros may be selectively executed 354, 356, 358, 360 as desired by the operator or the macro procedure may be terminated 362.

Figure 7:
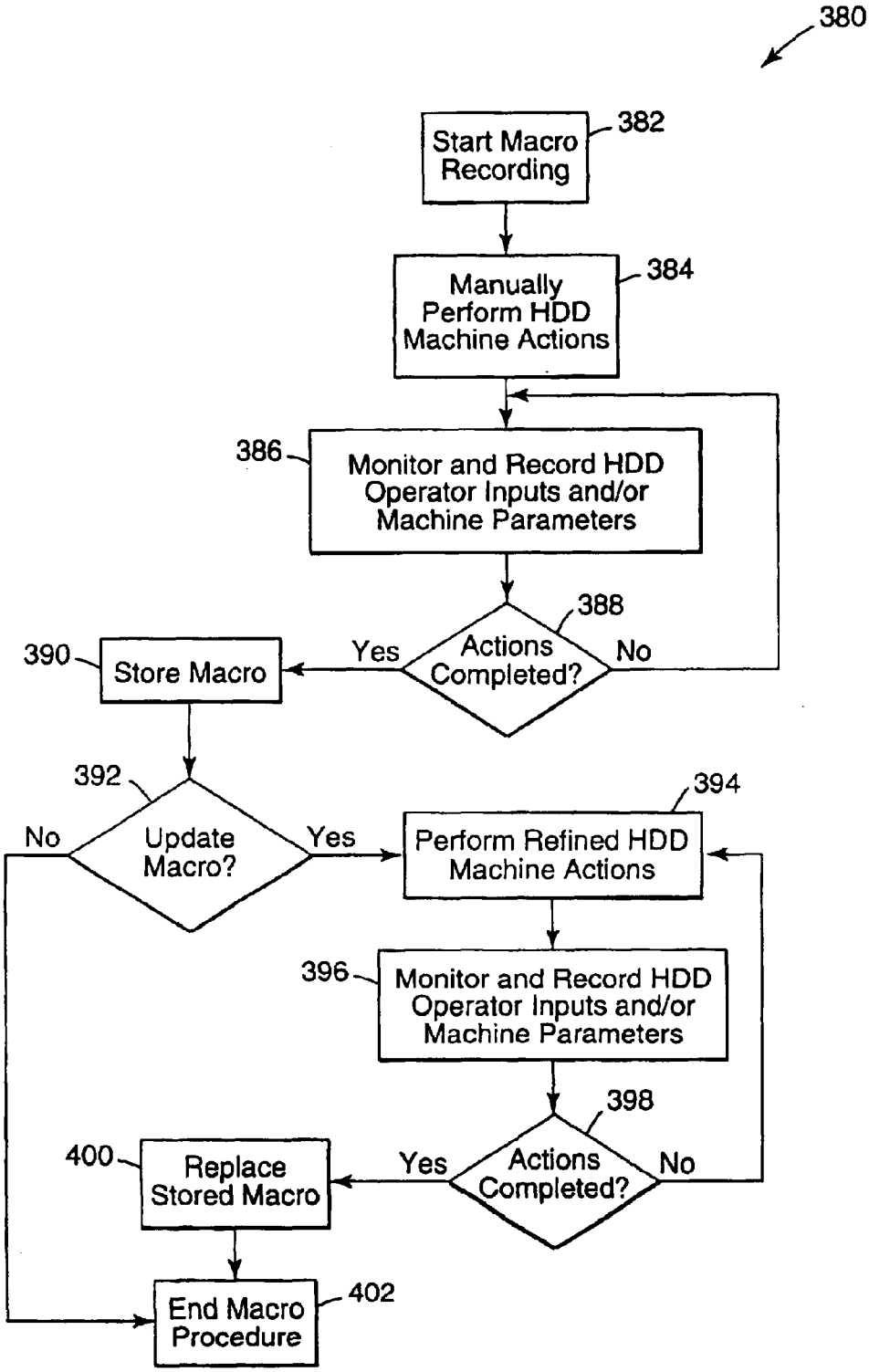

FIG. 7 shows various steps associated with the creation and modification of a macro in accordance with a further embodiment of the present invention. According to this embodiment, an operator initiates macro recording 382 and manually performs 384 the desired HDD machine actions that will define the macro. The operator inputs and/or machine parameters are monitored and recorded 386 and, upon completion of the desired HDD machine actions 388, the macro is stored 390.

If the operator desires to update the macro 392, any or all of the HDD machine actions that define the macro subject to updating are performed 394. The refined HDD machine actions are monitored and recorded 396, such as by recording of the operator inputs and/or HDD machine parameters. Upon completion 398 of all or selected HDD machine actions, the original macro is replaced by the recently defined macro and stored 400. The macro procedure may then be terminated 402 by the operator.

In accordance with one approach, an operator may select the macro to be updated or modified, and review the actions that are defined by the selected macro. The steps that are subject to refinement, modification, or replacement may be identified by the operator, such as by identifying macro step designators (e.g., step numbers) or graphically indicating the steps subject to refinement or replacement. This may be accomplished through various known means, including the use of conventional text blocking or identification techniques typically employed by word processing systems, for example.

According to another approach, a given step or series of steps associated with a selected macro may be subject to refinement by use of an averaging technique. For example, a series of steps associated with a previously stored macro may be repeated one or more times by the operator. The original macro steps together with the refined macro steps may be averaged for purposes of refining such macro steps. This process may be subject to iteration until the desired HDD machine response is achieved through the refinement process. It will be appreciated that, having stored a number of similar steps associated with a macro, the operator may selectively include or exclude specific macro step recordings from the averaging or refinement process. Upon completion of the desired series of actions 398, the refined macro may replace 400 the original stored macro or, alternatively, may be stored under a new macro name, thus preserving the original stored macro.

Figure 8:
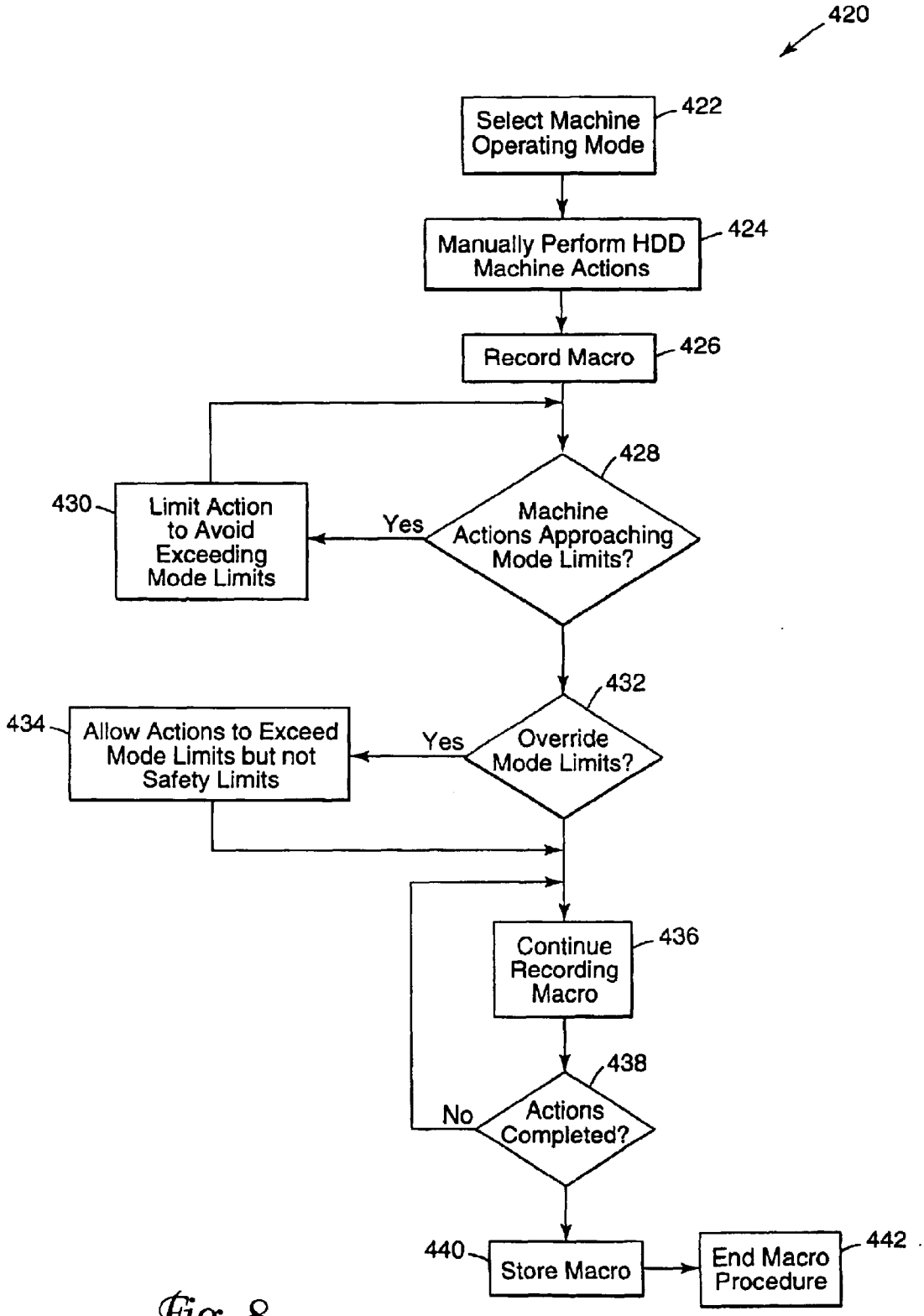

FIG. 8 illustrates various steps associated with recording a macro in accordance with an embodiment of the present invention. An operator initially selects 422 a pre-established HDD machine operating mode. Such operating modes typically include, for example, various steering modes, rod loading and unloading modes, mud system modes, HDD machine transport modes, thrust and/or rotation modes, cutting tool location/detection modes, and the like. After selecting the desired HDD machine mode, the operator manually performs 424 desired HDD machine actions while recording 426 a macro.

During the macro recording process, a determination is made, typically on a continuous monitoring basis, whether the HDD machine actions are approaching limits associated with the selected operating mode 428. If, during the macro recording process, the HDD machine actions encroach on the pre-specified limits associated with the given operating mode, the HDD machine actions are automatically limited to avoid exceeding the mode limits 430. The user may have the option to override the mode limits 432 for a given series of HDD machine actions. In such a case, the mode limits may be overridden by the operator such that the HDD machine actions may exceed the mode limit, but are not permitted to exceed predefined HDD machine safety limits 434. The macro recording process continues 436 until such time as the desired HDD actions are completed 438. The macro associated with the HDD machine actions for the selected operating mode is then stored 440, followed by termination of the macro procedure 442.

Figure 9:
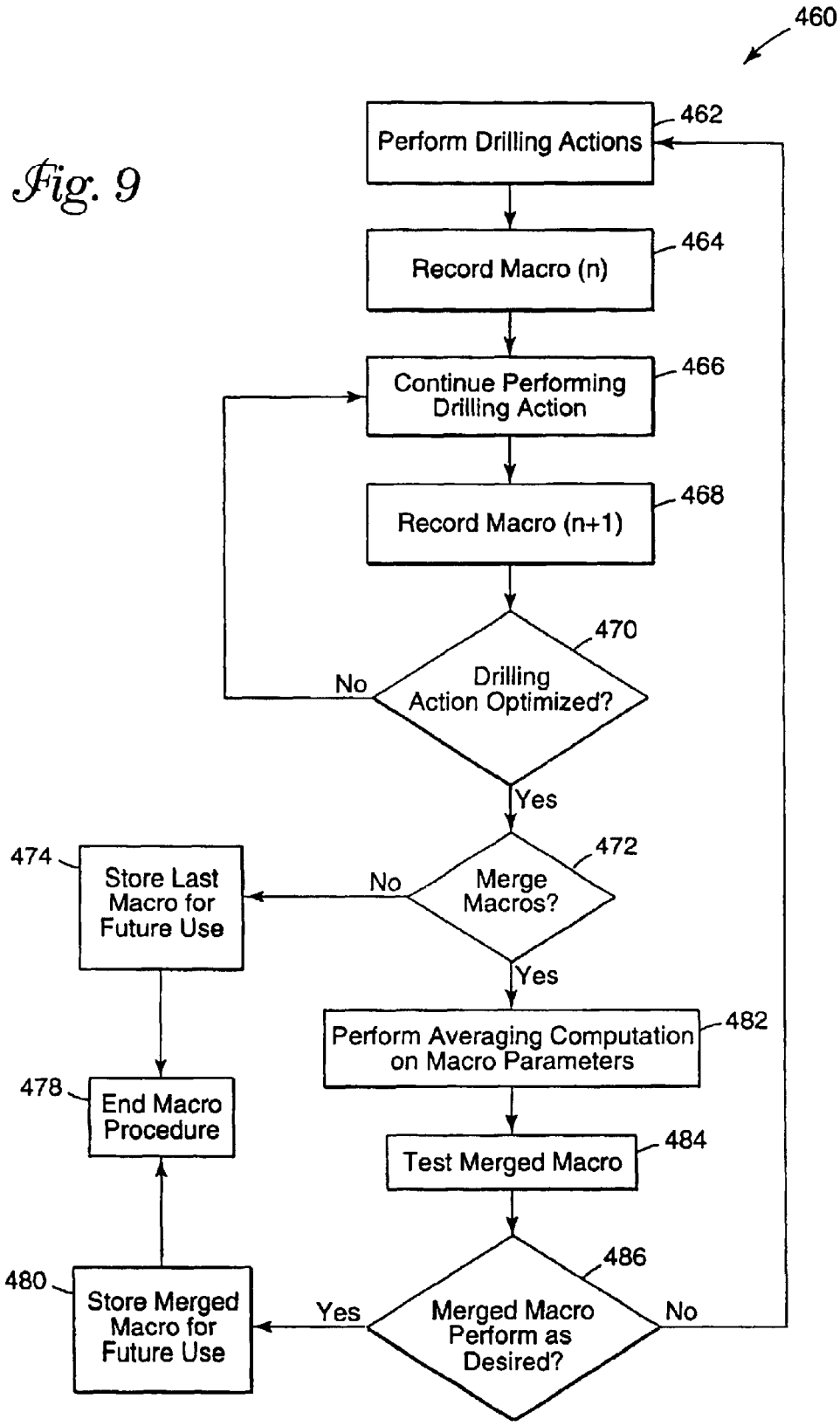

FIG. 9 illustrates various steps associated with the merging of two or more macros in accordance with an embodiment of the present invention. In accordance with a macro merge procedure according to this embodiment, the operator performs 462 the desired drilling actions which are recorded as a first macro, macro (n). Subsequently, additional drilling actions are performed 466 during which an additional macro, macro (n+1), is recorded 468. The operator may continue performing desired drilling actions so as to optimize 470 a given series of actions, during which subsequent macros may be recorded 468. After recording (n+1) macros, the operator is given the option to merge 472 all or selected ones of the recorded (n+1) macros. Should the operator enable the merge macro operation, an averaging computation or other merge computation is performed 482 on the parameters that define the macro.

The operator may then test 482 the merged macro, in which case the HDD machine operations are autonomously executed as defined by the merged macro. If the operator is satisfied that the merged macro performs 486 as desired, the merged macro may then be stored 480 for future use. If the operator decides not to merge the macros at step 472, the last macro of the (n+1) macros may be stored 474 for future use. It is understood that any of the recorded (n+1) macros may be stored for future use in addition to the last stored macro.

Figure 10:
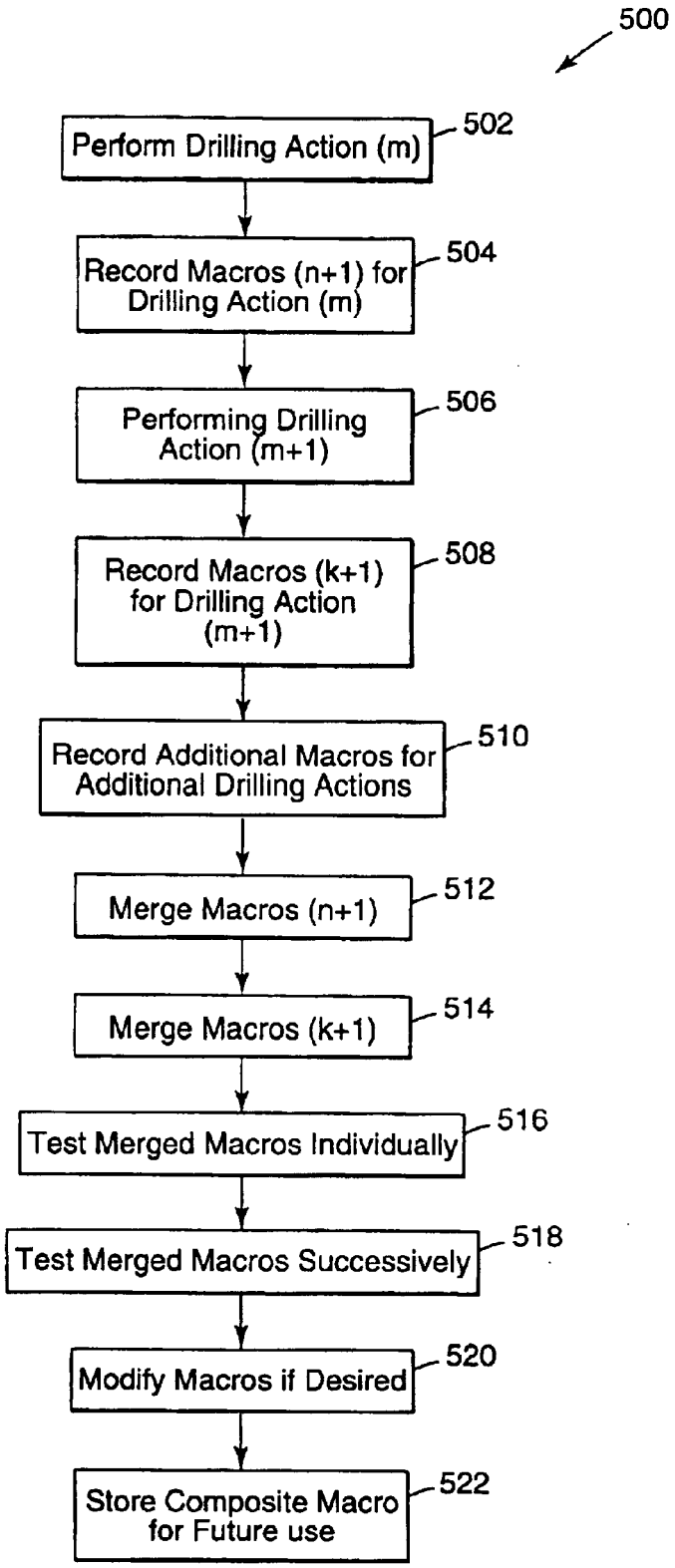

FIG. 10 illustrates various steps associated with recording macros for each of the number of distinct drilling actions and then merging the distinct drilling action macros together to produce multiple drilling action macros. According to this approach, an operator performs a given drilling action (n) 502 and records 504 (n+1) macros for the drilling action (n). The operator may then perform a different drilling action (n+1) 506 and record 508 a number of macros (k+1) for the new drilling action (n+1). If desired, the operator may perform additional drilling actions and record 510 one or more macros for each of the additional drilling actions.

The (n+1) macros associated with drilling action (n) may be merged 512. The (k+1) macros associated with drilling action (n+1) may then be merged 512. It is understood that individual macros associated with each additional drilling action in connection with step 510 may also be subject to merging at this point. Each of the merged macros may then be tested 516 individually. The individual merged macros may, of course, be subject to editing or modification at this stage. The merged macros may then be tested 518 successively to ensure that the compound set of drilling actions perform as desired. The merged macros, subject to merging operations in step 512 and 514, may be referred to as a super-macro, which may be subject to testing at step 518. The super-macro may be modified as desired 520 to fine-tune the drilling actions associated with the super-macro. The super-macro, which is essentially a composite macro, may be stored 522 for future use.

Figure 11:
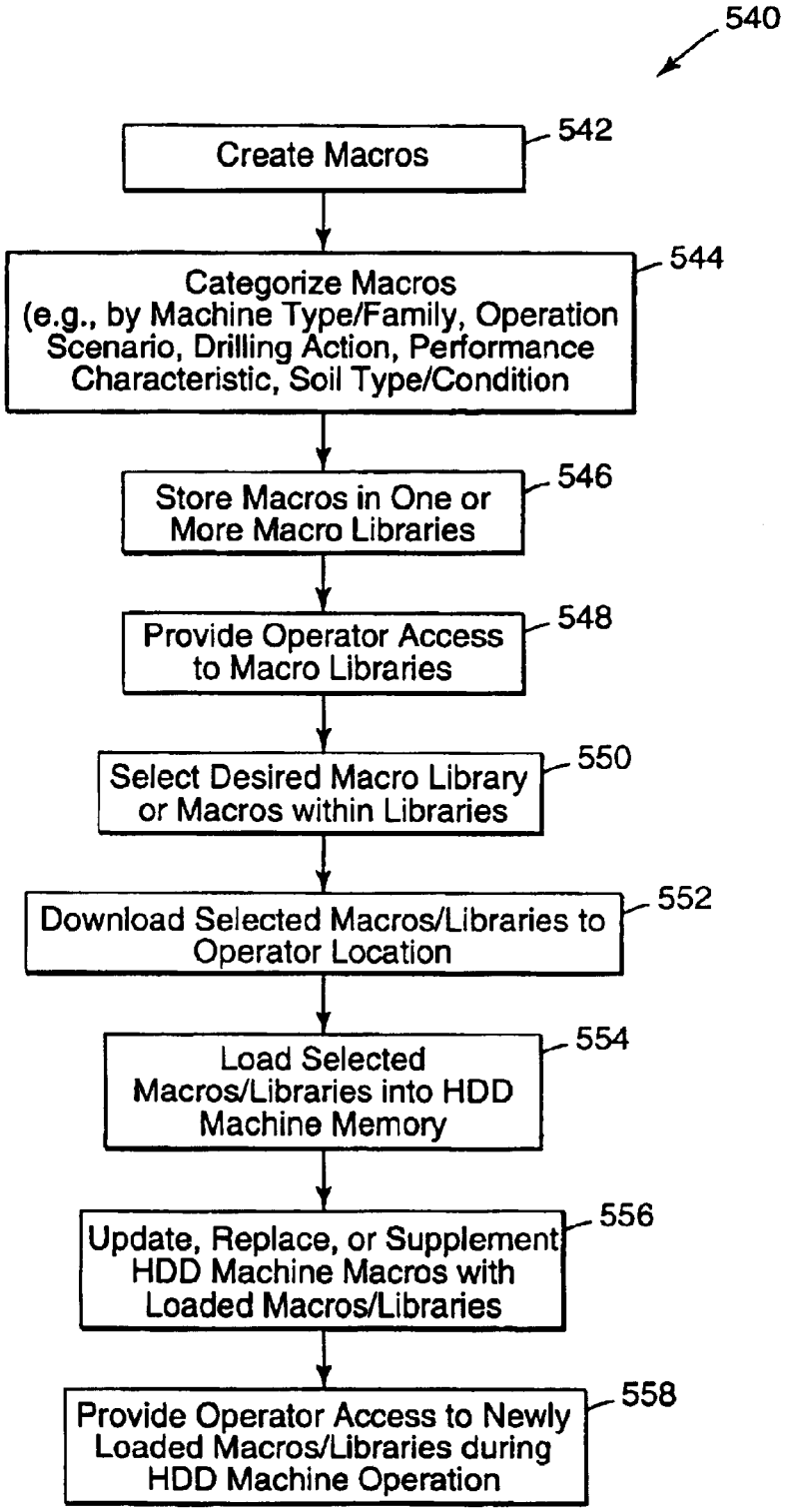

FIG. 11 illustrates various steps associated with the categorization of macros into libraries. It is assumed that a number of macros have been created 542 by one or more operators of one or more HDD machines. The family of macros may be categorized 544 in any number of useful ways. By way of example, each macro, sub-macro, or super-macro may be categorized in terms of HDD machine type or family, operating scenario, drilling action, performance characteristics, and/or soil type and condition, for example. It will be appreciated that other categories for identifying and organizing macros may be useful, and that any given macro may be categorized as having multiple identifiers. The categorized macros may be stored 546 in one or more macro libraries.

Macro libraries are preferably made accessible 548 to HDD machine operators, dealers, integrators and/or manufacturers. For example, libraries of macros may be maintained on one or more servers of a network and made accessible through appropriate interfaces to HDD operators. The macro libraries may be accessed by operators, dealers, manufacturers, and integrators via the World Wide Web or other Internet or proprietary network interface.

An operator or other interested party may gain access to the macro libraries 548 through the appropriate interface, which typically includes satisfying requisite security protocol. The operator may then select 550 a desired macro library or specific macros within particular libraries. The selected macros, sets of macros, or macro libraries may be downloaded 552 to the operator location.

By way of example, selected macros and macro libraries may be downloaded to a personal computer, hand-held personal agent, or other computer resource provided at or accessible to the operator at the operator's location. Alternatively, the selected macros or libraries may be downloaded directly into HDD machine memory 554. In this scenario, a wireless link, such as a mobile phone link, satellite link, or proprietary wireless link, may be used to establish the transmission of selected macros or macro libraries from the macro server system to the HDD machine memory, which is typically in the field or at a remote location. The downloaded macros or macro libraries may update, replace, or supplement 556 the HDD machine macros already stored in HDD machine memory. The operator of the HDD machine may then gain access 558 to the newly downloaded macros or macro libraries during HDD machine operation.

FIG. 12 illustrates various steps associated with the selection of macros based on HDD machine operating conditions in the field. In accordance with this approach, an operator selects 572 the HDD machine operating scenario best describing the drilling scenario perceived by the operator. Typically, the operating scenarios are preferably defined or accommodated by the predefined operating modes associated with a particular HDD machine.

By way of example, the various operating scenarios or HDD machine modes may encompass machine actions associated with drilling or reamer operations at the entrance or exit pit. Other operating scenarios may be associated with displacing the cutting tool along a straight or curved path. Various steering techniques are also typically defined by selectable operating scenarios or HDD machine modes. The use of a cutting tool or a reamer may be specifically specified by the operator. The type of soil encountered by the cutting tool or reamer may be specified, such as soft, medium, or hard soil, for example. An obstacle avoidance operating scenario may also be selected. Rod threading and unthreading represents additional operating scenarios that may be selectable by the operator. Various operating scenarios or HDD machine modes associated with mud flow, mud characteristics, or mud system performance may also be selectable.

After the operator selects the particular HDD machine operating scenario of interest, the operator is presented with macro selections based on the selected operating scenario 574. The operator may then select and execute the desired macro 576. If the action or performance 578 is not acceptable, the operator may select another macro for execution 574, 576. If the action or performance associated with the selected macro is acceptable 578, macro execution may be subject to change by the operator if the operating scenario changes 580. In such a case, the operator may select a new HDD machine operating scenario at step 572. If the operating scenario has not changed significantly, macro execution may continue 582 until the desired action or series of actions is completed 584, at which time the macro procedure may be terminated 586.

FIG. 13 illustrates various steps associated with the autonomous execution of HDD machine actions in connection with an auto-boring procedure. In accordance with the approach depicted in FIG. 13, a bore plan may be developed and programmed for a particular job site. The bore plan may be developed using conventional techniques or by the techniques disclosed in commonly-owned U.S. Pat. No. 6,389,360, entitled "AUTOMATED BORE PLANNING METHOD AND APPARATUS FOR HORIZONTAL DIRECTIONAL DRILLING," filed on Jan. 13, 2000, which is hereby incorporated herein by reference in its entirety. The predefined bore plan may be loaded into the HDD machine memory 602. The operator may specify additional initial operating parameters 604 appropriate for the boring operation. The auto-boring procedure may then be initiated 606. It is assumed for purposes of this and other examples that the location of the cutting tool (e.g., boring head or reamer) is determined and controlled by conventional means or by techniques disclosed in commonly-owned U.S. Pat. Nos. 5,720,354, 5,904,210, 5,819,859, 5,553,407, 5,704,142, and 5,659,985, each of which is hereby incorporated herein by reference in its respective entirety.

The auto-boring procedure determines the operating scenario 602 by comparing the present location of the cutting tool as compared to the planned location of the boring tool as specified by the bore plan loaded in HDD machine memory. For example, initiating the pilot bore will occur at the entrance pit as specified by the bore plan, in which case the appropriate operating scenario at this stage of the drilling operation concerns the entrance pit operating scenario. Having determined the appropriate operating scenario 608, the macro library associated with the particular operating scenario is accessed 610. Depending on various operating, performance, and soil factors, for example, the optimal macro for the particular operating scenario defined within the accessed macro library is selected 612. The selected optimal macro is then executed 614.

If the actions or performance associated with the executed selected macro is/are not acceptable 616, the operator may override the macro 618 and manually access an appropriate macro library associated with the particular operating scenario. The manually-selected macro may then be executed 614. If the actions or performance associated with the selected macro is/are acceptable 616, drilling operations continue until a new scenario is encountered 624.

For example, after the cutting tool reaches a predefined depth after passing through the entrance pit as specified by the bore plan, a substantially horizontal path may be dictated by the bore plan. The transition from the initial entrance pit boring operation to substantially horizontal drilling represents a change in the operating scenario. In view of the change of operating scenario 624, the auto-boring procedure determines the new operating scenario 608 in view of the bore plan and accesses 610 the macro library associated with the new operating scenario. Selection of the optimal macro 612, execution of same 614, and operator override steps 618 may then be repeated for the new operating scenario. Each change in operating scenario may result in a repeat of steps 608–518.

If the operator wishes to override a particular macro 618, the auto-boring mode of operation is discontinued 620. The operator may then select 622 a particular macro for execution or may operate the HDD machine in a manual mode of operation.

Provided above are several examples of macro-assisted operations for enhancing control of an HDD machine during use in accordance with the principles of the present invention. These examples are intended to enhance an understanding of the present invention, and are not to be regarded as limiting the scope or application of the present invention.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What I claim is:

1. A method of controlling a horizontal directional drilling (HDD) machine having a cutting tool coupled to a drill pipe, comprising:

controlling the HDD machine to move the culling tool along an underground path in accordance with a pre-established bore plan;

detecting, from above-ground, cuffing tool movement;

accessing, during HDD machine operation, one or more control programs, each of the control programs causing the HDD machine to execute a sequence of pre-defined HDD machine actions; and executing a particular control program of the one or more control programs to augment movement of the drill pipe or cutting tool.

2. The method of claim 1, wherein detecting cutting tool movement comprises confirming that the cuffing tool is progressing along the underground path.

3. The method of claim 1, wherein the particular control program defines a sequence of cutting tool location detection actions, and detecting cutting tool movement comprises detecting cutting tool orientation during execution of the sequence of cutting tool location detection actions.

4. The method of claim 1, wherein the particular control program defines a sequence of cutting tool location detection actions, and detecting culling tool movement comprises detecting cuffing tool depth during execution of the sequence of cutting tool location detection actions.

5. The method of claim 1, wherein the particular control program defines a sequence of cutting tool location detection actions, and detecting cutting tool movement comprises detecting cutting tool location during execution of the sequence of cutting tool location detection actions.

6. The method of claim 1, wherein detecting cutting tool movement comprises detecting a deviation of the cutting tool from the underground path, and execution of the particular control program augments movement of the cutting tool to change a heading of the cutting tool.

7. The method of claim 6, wherein the heading of the cutting tool is changed to direct the cutting back to the underground path.

8. The method of claim 6, wherein the heading of the cutting tool is purposefully changed to direct the cutting tool away from the underground path.

9. The method of claim 1, wherein detecting cutting tool movement comprises detecting an underground obstruction, and execution of the particular control program augments movement of the cutting tool to avoid the detected underground obstruction.

10. The method of claim 1, wherein accessing the one or more control programs further comprises manually selecting the particular control program for execution.

11. The method of claim 1, wherein accessing the one or more control programs further comprises automatically selecting the particular control program for execution.

12. The method of claim 1, wherein the cutting tool comprises a boring tool or a reamer, and the one or more control programs define a sequence of boring tool or reamer actions to enhance progression of the boring tool or reamer through earth.

13. The method of claim 1, wherein the one or more control programs define a sequence of rod loading or unloading actions.

14. The method of claim 1, wherein the HDD machine comprises a mud system, further wherein the one or more control programs define a sequence of mud system actions.

15. The method of claim 1, wherein the one or more control programs comprise instructions that replicate an operator defined sequence of HDD machine actions.

16. The method of claim 1, further comprising:

manually performing the sequence of pre-defined HDD machine actions; and storing program instructions during manual performance of the sequence of pre-defined HDD machine actions, the one or more control programs comprising the stored program instructions.

17. The method of claim 1, further comprising detecting a change in an HDD machine performance characteristic, wherein executing the particular control program modifies movement of the drill pipe or cutting tool in response to the detected change in the HDD machine performance characteristic.

18. The method of claim 1, further comprising inputting a set of initial HDD machine operating parameters for controlling drill pipe or cutting tool movement, wherein executing the particular control program modifies execution of the set of initial HDD machine operating parameters.

19. The method of claim 1, wherein controlling the HDD machine comprises autonomously controlling the HDD machine to move the cutting tool along the underground path in accordance with the pre-established bore plan.

20. The method of claim 1, wherein controlling the HDD machine comprises manually controlling the HDD machine to move the cutting tool along the underground path in accordance with the pre-established bore plan, further wherein executing the particular control program augments or takes over manual control of the HDD machine.

21. A system for controlling a horizontal directional drilling (HDD) machine having a cutting tool coupled to a drill pipe, comprising:

an above-ground locator, a user interface comprising a user input device; and a controller, communicatively coupled to the user interface, configured to control the HDD machine to move the cutting tool along an underground path in accordance with a pre-established bore plan, the controller, during HDD machine operation, accessing one or more control programs each causing the HDD machine to execute a sequence of pre-defined HDD machine actions, the controller executing a particular control program of the one or more control programs to augment movement of the drill pipe or cuffing tool.

22. The system of claim 21, wherein the cutting tool comprises a boring tool.

23. The system of claim 21, wherein the cutting tool comprises a reamer.

24. The system of claim 21, wherein the user interface comprises a display.

25. The system of claim 21, wherein the user interface is situated at or on the HDD machine.

26. The system of claim 21, wherein the user interface is situated at or on the above-ground locator.

27. The system of claim 21, wherein a first user interface is situated at or on the above-ground locator, and a second user interface is situated at or on the HDD machine.

28. The system of claim 21, wherein the controller is situated at or on the HDD machine.

29. The system of claim 21, wherein the controller is situated at or on the above-ground locator.

30. The system of claim 21, wherein the controller accesses the one or more control programs in response to a manual instruction received by the user input device.

31. The system of claim 21, wherein the controller accesses the one or more control programs in response to a control signal generated by the controller.

32. The system of claim 21, wherein the controller accesses the one or more control programs in response to information received from the locator.

33. The system of claim 21, wherein the cutting tool comprises a boring tool or a reamer, and the one or more control programs define a sequence of boring tool or reamer actions to enhance progression of the boring tool or reamer through earth.

34. The system of claim 21, wherein the one or more control programs define a sequence of rod loading or unloading actions.

35. The system of claim 21, further comprising a mud system, wherein the one or more control programs define a sequence of mud system actions.

36. The system of claim 21, wherein the one or more control programs comprise instructions that replicate an operator defined sequence of HDD machine actions.

37. The system of claim 21, wherein the user input device comprises a start recording control and a stop recording control, the start recording control actuatable to initiate recording of program instructions during operator performance of the sequence of pre-defined HDD machine actions, and the stop recording control actuatable to terminate the recording of program instructions upon terminating the operator performance of the sequence of pre-defined HDD machine actions, the one or more control programs comprising the recorded program instructions.

38. The system of claim 21, wherein the controller autonomously controls the HDD machine to move the cutting tool along the underground path in accordance with the pre-established bore plan.

39. The system of claim 21, wherein the controller, in response to operator inputs received by the user input device, controls the HDD machine to move the cutting tool along the underground path in accordance with the pre-established bore plan, further wherein execution of the particular control program by the controller augments the operator inputs to operate the HDD machine in a semi-automatic or automatic mode.

40. A system for controlling a horizontal directional drilling (HDD) machine having a cutting tool coupled to a drill pipe, comprising:

means for controlling the HDD machine to move the cutting tool along an underground path in accordance with a pre-established bore plan;

means for detecting cutting tool movement from above-ground;

means for accessing, during HDD machine operation, one or more control programs, each of the control programs causing the HDD machine to execute a sequence of pre-defined HDD machine actions; and means for executing a particular control program of the one or more control programs to augment movement of the drill pipe or cutting tool.

41. The system of claim 40, further comprising means for confirming that the cutting tool is progressing along the underground path.

42. The system of claim 40, wherein the particular control program defines a sequence of cutting tool location detection actions, and the means for detecting cutting tool movement comprises means for detecting cutting tool orientation during execution of the sequence of cutting tool location detection actions.

43. The system of claim 40, wherein the particular control program defines a sequence of cutting tool location detection actions, and the means for detecting cutting tool movement comprises means for detecting cutting tool depth during execution of the sequence of cutting tool location detection actions.

44. The system of claim 40, wherein the particular control program defines a sequence of cutting tool location detection actions, and the means for detecting cutting tool movement comprises means for detecting cutting tool location during execution of the sequence of cutting tool location detection actions.

45. The system of claim 40, wherein the means for detecting cutting tool movement comprises means for detecting a deviation of the cutting tool from the underground path, and execution of the particular control program by the execution means augments movement of the cutting tool to change a heading of the cutting tool.

46. The system of claim 40, wherein the means for detecting cutting tool movement comprises means for detecting an underground obstruction, and execution of the particular control program by the execution means augments movement of the cutting tool to avoid the detected underground obstruction.

47. The system of claim 40, wherein the means for accessing the one or more control programs further comprises means for manually selecting the particular control program for execution.

48. The system of claim 40, wherein the means for accessing the one or more control programs further comprises means for automatically selecting the particular control program for execution.

49. The system of claim 40, wherein the cutting tool comprises a boring tool or a reamer, and the one or more control programs define a sequence of boring tool or reamer actions to enhance progression of the boring tool or reamer through earth.

50. The system of claim 40, wherein the one or more control programs define a sequence of rod loading or unloading actions.

51. The system of claim 40, further comprising a mud system, wherein the one or more control programs define a sequence of mud system actions.

52. The system of claim 40, wherein the one or more control programs comprise instructions that replicate an operator defined sequence of HDD machine actions.

53. The system of claim 40, further comprising:

means for manually performing the sequence of pre-defined HDD machine actions; and means for storing program instructions during manual performance of the sequence of pre-defined HDD machine actions, the one or more control programs comprising the stored program instructions.

54. The system of claim 40, further comprising means for detecting a change in an HDD machine performance characteristic, wherein executing the particular control program by the execution means modifies movement of the drill pipe or cutting tool in response to the detected change in the HDD machine performance characteristic.

55. The system of claim 40, further comprising means for inputting a set of initial HDD machine operating parameters for controlling drill pipe or cutting tool movement, wherein executing the particular control program by the execution means modifies execution of the set of initial HDD machine operating parameters.

56. The system of claim 40, wherein the means for controlling the HDD machine comprises means for autonomously controlling the HDD machine to move the cutting tool along the underground path in accordance with the pre-established bore plan.

57. The system of claim 40, wherein the means for controlling the HDD machine comprises means for manually controlling the HDD machine to move the cutting tool along the underground path in accordance with the pre-established bore plan, further wherein executing the particular control program by the executing means augments or takes over manual control of the HDD machine.

* * * * *

UNITED STATES PATENT AND TRADEMARK OFFICE

CERTIFICATE OF CORRECTION

PATENT NO. : 6,910,541 B2
DATED : June 28, 2005
INVENTOR(S) : Hans Kelpe

It is certified that error appears in the above-identified patent and that said Letters Patent is hereby corrected as shown below:

Column 16,
Lines 34 and 55, “culling” should be -- cutting --.
Lines 37, 46 and 56, “cuffing” should be -- cutting --.

Column 18,
Line 8, “cuffing” should be -- cutting --.

Signed and Sealed this

Twenty-fifth Day of October, 2005

JON W. DUDAS
*Director of the United States Patent and Trademark Office*